US005115622A

United States Patent [19]

Ammann et al.

[11] Patent Number: 5,115,622

[45] Date of Patent: May 26, 1992

[54] METHOD OF REINFORCING STRUCTURAL COMPONENTS

[75] Inventors: Walter Ammann, Bonstetten; Fritz Muenger, Gossau; Manfred Hartmann, Frastanz, all of Switzerland

[73] Assignee: Hilti Aktiengesellschaft, Fürstentum, Liechtenstein

[21] Appl. No.: 632,350

[22] Filed: Dec. 21, 1990

[30] Foreign Application Priority Data

Dec. 23, 1989 [DE] Fed. Rep. of Germany ..... 3942945

[51] Int. Cl.[5] ..... E04C 5/18

[52] U.S. Cl. ..... 52/741; 52/231; 52/514

[58] Field of Search ..... 52/223 R, 225, 231, 52/698, 741, 514; 264/228; 405/259; 411/344, 15, 18

[56] References Cited

U.S. PATENT DOCUMENTS 1,813,909 7/1991 Brainard et al. ..... 52/584
2,854,824 10/1958 Curry et al. ..... 405/259
3,139,730 7/1964 Williams et al. ..... 405/259
3,210,900 10/1965 Sattler ..... 52/334
3,282,017 11/1966 Rothermel ..... 52/741
3,368,016 2/1968 Birguer ..... 264/228
3,968,721 7/1976 Fischer ..... 411/18

*Primary Examiner*—James L. Ridgill, Jr.
*Attorney, Agent, or Firm*—Toren, McGeady & Associates

[57] ABSTRACT

Metal reinforcing members (3) are attached by bonding to a surface in the tension zone (1*a*) of a concrete structure component (1) for reinforcing the component. To prevent the ends of the reinforcing members (3) from separating from the structural component (1) when the component is subjected to load, attachment elements (4) clamp the ends of the reinforcing members against the surface of the component in addition to the bonding action. The attachment elements (4) apply such high compressive forces to the structural component, so that potentially damaging tension and shear forces can not be effective.

6 Claims, 2 Drawing Sheets

METHOD OF REINFORCING STRUCTURAL COMPONENTS

BACKGROUND OF THE INVENTION

The present invention is directed to a method of and a fastening element for securing reinforcement to a surface of concrete structural components, such as ceilings, beams and the like, where metal reinforcing members are bonded to a surface of the structural components in the tension zone of the component.

As is well known, concrete structural components are provided with reinforcing members while they are being constructed. Such structural components can be ceilings or covers, beams, bridges and the like.

If structural components must be reinforced due to changed external conditions, for instance if an increase in carrying capacity is desired, the use of additional reinforcing members is necessary. Since additional reinforcement can not be accommodated within the components without destroying them, it has been known to attach additional reinforcement by bonding to the surface of the structural components. The tension zone of the structural components is available for reinforcing members capable of being stressed in tension. As a rule, such reinforcement is formed of sectional steel, particularly sheet steel.

When structural components with such additional reinforcing members are subjected to a load, a relative offset in length takes place between the components and the reinforcing members due to the bending deflection of the structural components. Such offset may be of such a magnitude at the ends of the reinforcing members that they separate from the component. In such a situation, the weak point is not the bonding, but the component formed of concrete. In such a situation, while concrete can be highly loaded in compression, it is prone to failure if loaded in shear or tension. This condition results in a destruction of the concrete at the ends of the bonded reinforcement with a part of the component being torn off from the ends of the reinforcing members due to the relative offset.

SUMMARY OF THE INVENTION

Therefore, the primary object of the present invention is to provide a method which prevents the ends of the bonded reinforcement from being torn off from the surface of the structural components. Furthermore, another primary object of the present invention is to provide a device for implementing the method, in particular, a fastening element.

In accordance with the present invention, the ends of the reinforcing members bonded to the surface of the structural component are secured by fastening or attachment members.

The method of the present invention is based on the fact that concrete can be adequately loaded in compression. By clamping the ends of the reinforcing members against the structural components, compressive forces are generated and superimposed on possible shear and tension forces developed when the component is loaded, so that the possibly damaging shear and tension forces are counterbalanced without any damaging effect. Accordingly, only stresses causing no problems for the concrete structural component act upon it.

In a preferred embodiment of the invention, two reinforcing members extending alongside one another are secured by fastening elements positioned symmetrically between the ends of the two adjacent reinforcing members. As a result, there is a uniform division of the loads acting on the reinforcing members as well as on the fastening or attachments elements.

The attachments elements used in carrying out the method have an anchoring region where they are fixed to the component and an abutment shoulder arranged directly or indirectly in contact with the reinforcing members. A collar, bolt head or bolt nut on the attachment element can form the abutment shoulder.

Preferably, the abutment shoulder of the attachment element is offsettable from or spaced from the anchoring region so that it clamps the attachment element whereby compressive forces can be generated having an advantageous effect on the reinforcing members.

An anchor known as such can be utilized as the attachment or fastening element. Either a chemical or mechanical anchor can be used, as long as the desired spacing or offset of the abutment shoulder with respect to the anchoring region is present. While a chemical anchor can be used in a known manner as an anchor rod grouted into the structural component, the anchoring region of a mechanical anchor is preferable where an expansion sleeve is used in combination with an expansion cone with the cone being drawn into and expanding the sleeve.

To assure that the reinforcing members are adequately clamped against the structural component while it is not under load, a prestressable member is positioned between the abutment shoulder and the reinforcing members. Such a prestressable element can be formed of an elastic material. In view of the possibility of high loads or stresses acting on the structural component, it is preferable if the prestressable member is formed of metal, such as spring washers or Belleville springs, that is, a generally flat conical spring washer, note FIG. 3.

For transmitting the loads or stresses adequately and without damaging the prestressable members, it is possible to position a compression piece between the abutment shoulder of the attachment element and the prestressable member, such as in the form of a Belleville spring.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
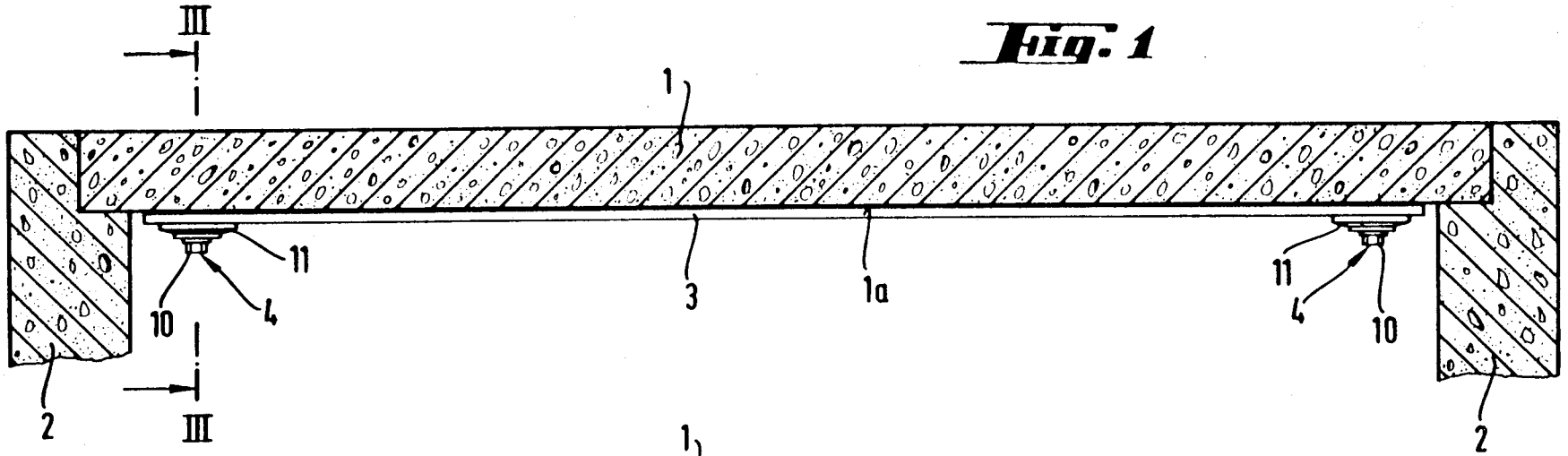
FIG. 1 is a sectional view through a cover or ceiling provided with reinforcing members embodying the present invention.

A concrete structural component 1, such as a cover or ceiling, is set forth in FIG. 1 with opposite ends of the component resting on walls 2. It is assumed that the component forms a ceiling and is loaded on its upper surface, whereby the lower region of the component acts as a tension zone la and has reinforcing members 3 bearing against the lower surface of the component. The reinforcing members are bonded to the lower surface of the component 1.

Figure 2:
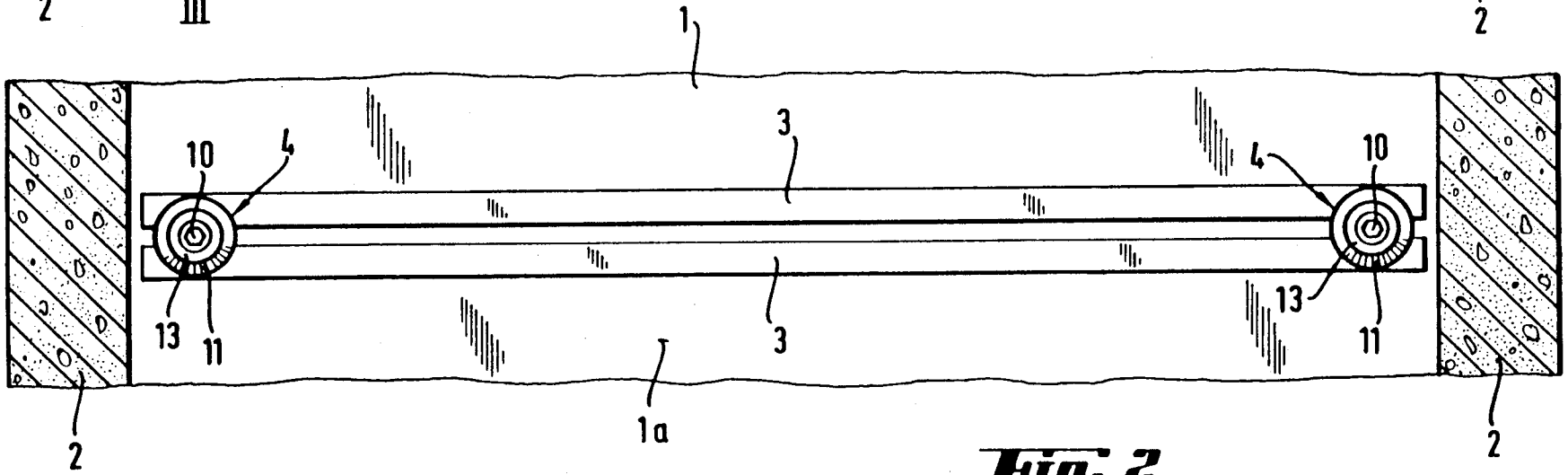
FIG. 2 is a bottom view of the structural component shown in FIG. 1, displayed partly in section.

As shown best in FIG. 2, two reinforcing members 3 extend parallel to one another and are fastened to the component 1. The opposite ends of the reinforcing members 2 are clamped by attachments elements 4 to the lower surface of the structural component 1. Preferably, the attachment elements 4 are located between the two adjacent reinforcing members 3 so that the attachment elements overlap the ends of the reinforcing members.

Figure 3:
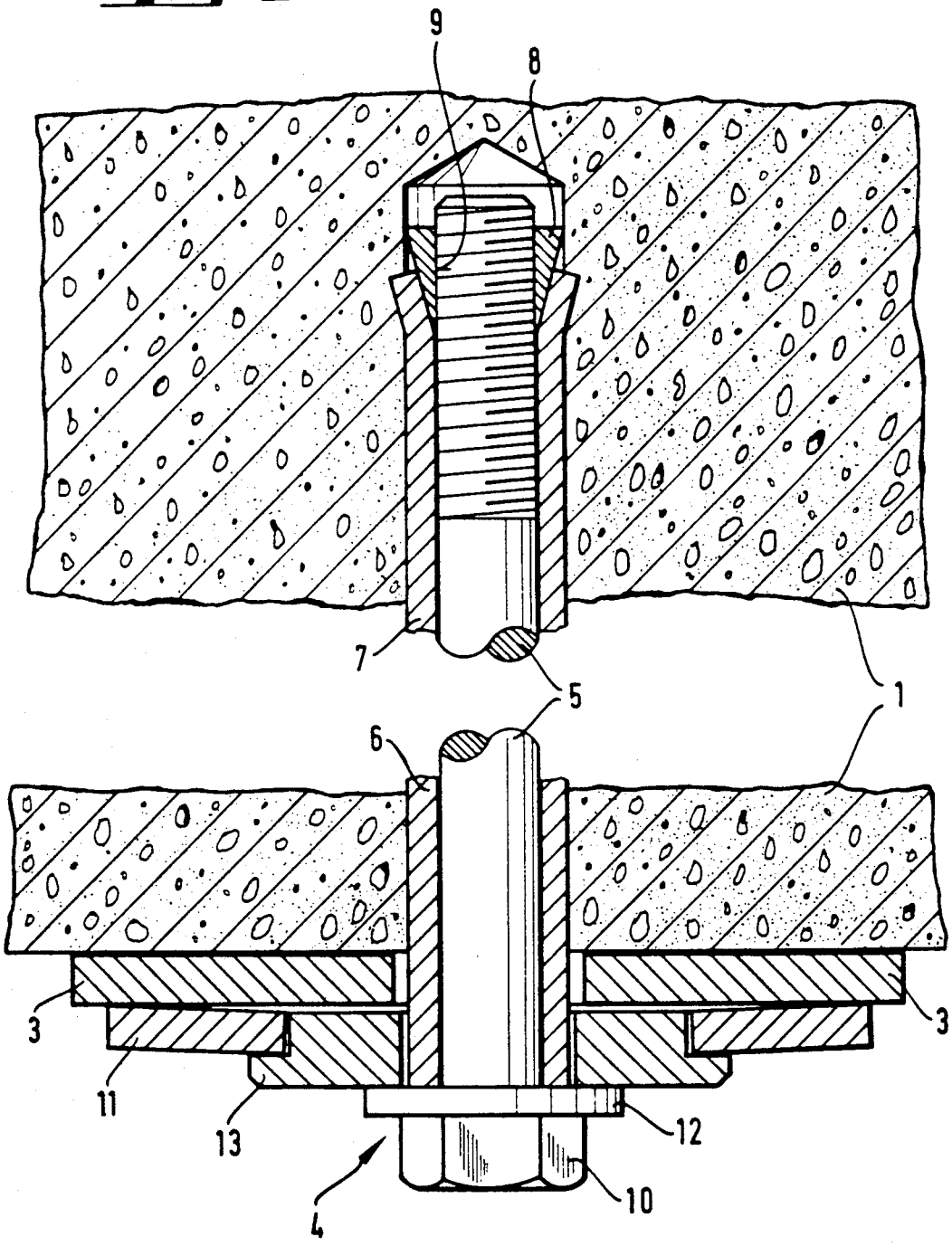
FIG. 3 a partial sectional view taken along the line III—III in FIG. 2 and shown on an enlarged scale.

The arrangement and makeup of the attachment elements 4 is shown in detail in FIG. 3. In FIG. 3 the attachment element 4 is a mechanical anchor including an axially extending anchor bolt 5, a spacer sleeve 6, an expansion sleeve 7 and an expansion cone 8 on the end of the bolt located within the structural component 1. Expansion cone 8 is connected to the inner end of the anchor bolt 5 by thread 9, the outer end of the anchor bolt has an abutment shoulder 10 in the form of a bolt head.

As shown in FIG. 3, the ends of the two reinforcing members 3 are simultaneously clamped by the attachment element against the lower surface of the structural component 1. In addition, a prestressable element 11, in the form of a Belleville spring, is positioned between the abutment shoulder 10, in the form of a bolt head, and the lower surface of the reinforcing members 3. For adequate transmission of the prestressing forces from the abutment shoulder 10 to the prestressable member 11, a compression piece 13 and a washer 12 are used. Note the washer 12 on one side bears against the abutment shoulder formed by the bolt head 10 and on the opposite side presses against the compression piece 13 which, in turn, bears against the prestressable element The attachment element 4 acts in the manner of a known mechanical anchor, that is, by turning the bolt head 10 the bolt is threaded through the expansion cone, and, in turn, the expansion cone moving toward the lower surface of the structural component expands the expansion sleeve securing the bolt in position.

The abutment shoulder 10 is formed as a bolt head with engagement faces for effecting the rotational movement of the anchor bolt. The prestressable element 11 assures an adequate prestress after the load acting on the structural component is relaxed.

While specific embodiments of the invention have been shown and described in detail to illustrate the application of the inventive principles, it will be understood that the invention may be embodied otherwise without departing from such principles.

We claim:

1. Method of reinforcing concrete structural components (1), such as ceilings, beams or the like, by bonding elongated metal reinforcing members (3) having opposite ends spaced apart in the elongated direction to a surface of the concrete structural component (1) in the region of a tension zone therein, comprising the steps of clamping the opposite ends of the reinforcing members (3) against the surface of the structural component by means of attachment members (4) having a pair of opposite ends, securing one of the opposite ends of the attachment members within the concrete structural component (1), locating the other opposite end outwardly from the surface of the concrete structural component and from the metal reinforcing members (3), providing an abutment shoulder (10) on the other opposite end, and placing a prestressable element (11) between the abutment shoulder and the reinforcing member for prestressing the attachment member (4).

2. Method, as set forth in claim 1, comprising the further step of providing a pair of reinforcing members (3) extending in generally parallel relation and clamping the adjacent ends of each of the reinforcing members to the structural component (1) by symmetrically arranging at least one attachment element (4) between the reinforcing members.

3. Method, as set forth in claim 1, wherein means (7, 8) are located adjacent to the one end for anchoring the attachment member (4) within the structural component (1), an abutment member (10) forming the abutment shoulder located at least adjacent the other end of the attachment element for securing at least one reinforcing member (3) to the surface of the structural component.

4. Method, as set forth in claim 3, wherein said attachment element (4) is an axially elongated bolt (5) having a thread (9) at the one end thereof and a bolt head (10) at the other end thereof with said bolt head forming said abutment shoulder (10), an expansion sleeve (7) encircling said bolt at least adjacent the first end thereof within the structural component (1), an expansion cone (8) threaded onto the thread of said bolt within the structural component (1) and arranged to be drawn into said expansion sleeve for expanding said expansion sleeve within the structural component (1), and the prestressable element (11) in contact with said reinforcing member and arranged to be pressed against said reinforcing member (3) by said bolt head (10).

5. Method, as set forth in claim 3, wherein said anchoring means (7, 8) comprises an expansion sleeve (9) encircling said attachment element (4) adjacent the one end thereof and located within the structural component (1), and an expansion cone (8) in cooperation with said expansion sleeve and located within the structural component, so that as said expansion cone is moved in the direction from the one end toward the other end of the attachment element the expansion sleeve is expanded.

6. Method, as set forth in claim 5, wherein the prestressable element (11) is a flat conical spring washer.

* * * * *